US006045910A

United States Patent [19]

Lambrechts

[11] Patent Number: 6,045,910

[45] Date of Patent: Apr. 4, 2000

[54] STEEL WIRE ELEMENT FOR MIXING INTO SUBSEQUENTLY HARDENING MATERIALS

[75] Inventor: Ann Lambrechts, Herentals, Belgium

[73] Assignee: N. V. Bekaert S. A., Zwevegem, Belgium

[21] Appl. No.: 09/044,031

[22] Filed: Mar. 19, 1998

Related U.S. Application Data

[63] Continuation of application No. PCT/EP96/04080, Sep. 18, 1996.

[30] Foreign Application Priority Data

Sep. 19, 1995 [BE] Belgium ..... 9500769

[51] Int. Cl.[7] ..... D02G 3/22

[52] U.S. Cl. ..... 428/399; 428/364; 428/379; 428/397; 428/400

[58] Field of Search ..... 428/364, 399, 428/400, 397, 379

[56] References Cited

U.S. PATENT DOCUMENTS

| | | |
|---|---|---|
| 3,533,003 | 10/1970 | Carlton et al. . |
| 3,684,474 | 8/1972 | Chisholm . |
| 3,900,667 | 8/1975 | Moens . |
| 3,942,955 | 3/1976 | Moens . |
| 3,953,053 | 4/1976 | Marsden . |
| 4,233,364 | 11/1980 | van Thiel . |
| 4,308,705 | 1/1982 | Hufnagl . |
| 4,610,926 | 9/1986 | Tezuka . |
| 5,359,873 | 11/1994 | Grondziel . |
| 5,865,000 | 2/1999 | Nemegeer et al. . |

FOREIGN PATENT DOCUMENTS

| | | |
|---|---|---|
| 0 105 385 | 4/1984 | European Pat. Off. . |
| 0 582 905 | 2/1994 | European Pat. Off. . |
| 0 608 013 | 7/1994 | European Pat. Off. . |
| 90 00 846 U | 6/1991 | Germany . |
| 40 09 986 | 10/1991 | Germany . |
| 92 07 898 | 10/1992 | Germany . |
| 93 02 557 | 4/1993 | Germany . |
| 93 01 153 | 6/1993 | Germany . |
| 42 42 150 | 6/1994 | Germany . |
| 6 294 017 | 10/1994 | Japan . |
| 1 446 855 | 8/1976 | United Kingdom . |

OTHER PUBLICATIONS

Bekaert Specification AS–20–01 (4 pages)—Apr. 1995.
Bekaert Specification AS–20–02 (3 pages)—Apr. 1995.

*Primary Examiner*—William Krynski
*Assistant Examiner*—J. M. Gray
*Attorney, Agent, or Firm*—Shlesinger, Arkwright & Garvey LLP

[57] ABSTRACT

Steel wire element for mixing into subsequently hardening soft materials includes hook-shaped ends and a middle portion the length/diameter ratio of which is between 20 and 100. The middle portion of the element displays a substantially circular cross section over essentially its entire length and the hook-shaped ends of the element are deformed by flattening.

29 Claims, 2 Drawing Sheets

STEEL WIRE ELEMENT FOR MIXING INTO SUBSEQUENTLY HARDENING MATERIALS

CROSS REFERENCE TO RELATED APPLICATIONS

This application is a continuation of Application Ser. No. PCT/EP96/04080, filed Sep. 18, 1996 which claims the priority of Belgian Application No. 9500769, filed Sep. 19, 1995, and each of which is incorporated herein by reference.

FIELD OF THE INVENTION

The invention relates to a steel wire element for mixing into subsequently hardening soft materials, said element consisting of hook-shaped ends and a middle portion the length/diameter ratio of which is between 20 and 100.

BACKGROUND OF THE INVENTION

Such wire elements for reinforcing subsequently hardening materials, such as concrete are known from the Dutch patent 160,628 and the corresponding U.S.A. Pat. Nos. 3,900,667 and 3,942,955 of the applicant N.V. BEKAERT S.A. and are marketed worldwide by the applicant under the brand name DRAMIX®. The technical characteristics of the DRAMIX steel wire fibers are described in Bekaert specifications AS-20-01 (4 pages) and AS-20-02 (3 pages) of April 1995.

Each one of Dutch Patent 160,628, U.S. Pat. Nos. 3,900,667 and 3,942,955, Bekaert specifications AS-20-01 and AS-20-02 is incorporated herein by reference.

By steel wire fibers or elements with hook-shaped ends is to be understood, on the one hand, steel wire fibers with L-shaped or bent ends, such as described, for example, in Dutch patent 160,628, and, on the other hand, steel wire fibers with Z-shaped ends, such as described in Bekaert specifications AS-20-01 and AS-20-02. In what follows, steel wire fibers with L-shaped and Z-shaped ends are described in greater detail in the sections specifically dealing with the figures.

An important aim of adding steel wire fibers to concrete is to improve the bending strength of the steel fiber reinforced concrete. The determination of the bending tensile strength, the bending strength and the equivalent bending tensile strength of steel fiber reinforced concrete is described in Dutch Recommendation 35 of the Civil-Technical Center for the Implementation of Research and Regulations (in brief, CUR35) and in the Belgian standards NBN B15-238 and NBN B15-239.

With the addition of steel wire fibers to concrete, it has been found that the bending strength and the equivalent bending tensile strength increase considerably with increasing amounts of steel wire fibers.

One disadvantage of this, however, is that the cost price of the steel fiber reinforced concrete thus obtained increases with the increasing amounts of steel wire fibers. It is for this and other reasons that many new types of steel wire fibers have been developed with a great variety of different possible embodiments in which the aim has always been to obtain an equal improvement of the technical characteristics of the steel fiber reinforced concrete with the addition of smaller amounts of steel wire fiber to the concrete.

One important group of steel wire fibers that gives rise to a considerable improvement of the technical characteristics of the steel fiber reinforced concrete thus obtained is the group of steel wire fibers having hook-shaped ends, such as already mentioned above.

OBJECTS AND SUMMARY OF THE INVENTION

It is an object of the invention to provide a new type of steel wire element in which the technical characteristics of the steel fiber reinforced concrete thus obtained are even further improved, or in which it is possible to lower the cost price of the steel fiber reinforced concrete thus obtained due to the fact that the desired technical characteristics of the steel fiber reinforced concrete can be obtained with the addition of smaller amounts of steel wire elements to the concrete.

For this purpose, the invention proposes a steel wire element of the type mentioned in the introduction in which the middle portion of the steel wire element displays a substantially circular cross-section over essentially its entire length and in which the hook-shaped ends of the steel wire element are deformed by flattening.

It should be noted that the idea of flattening the steel wire fibers over their entire length is already known from Japanese patent 6-294017 (deposited for examination on Oct. 21, 1994). From German patent G9207598 the idea is also already known of flattening only the middle portion of a steel wire fiber with hook-shaped ends. Furthermore, from U.S. Pat. No. 4,233,364 the idea is already known of using straight steel wire fibers without L or Z hook-shaped ends: the ends of these fibers are flattened and provided with a flange in a plane essentially perpendicular to the flattened ends.

Each one of Japanese Patent No. 6-294017, German Patent No. G 9207598, and U.S. Pat. No. 4,233,364 is incorporated herein by reference.

BRIEF DESCRIPTION OF THE DRAWINGS

The invention will be explained in further detail in the following description on the basis of the accompanying drawing.

In the drawing.

DETAILED DESCRIPTION OF THE INVENTION

Figure 1:
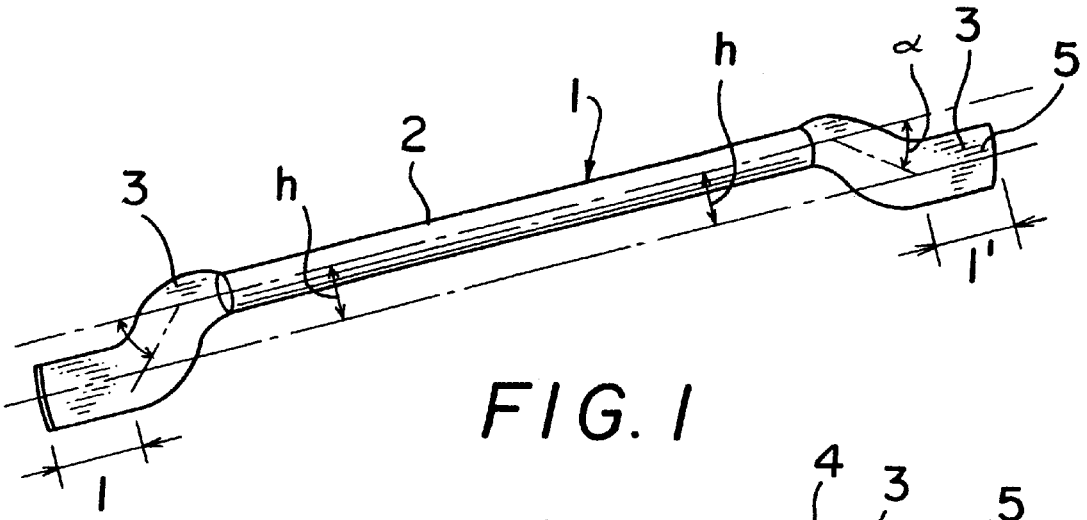
FIG. 1 shows in perspective a first embodiment of a steel wire element according to the invention, in which the Z-shaped ends are flattened in a plane which is parallel with the plane of the wire element.

FIG. 1 shows a first embodiment of a steel wire element or fiber 1 according to the invention. The fiber 1 consists of a middle portion 2 and Z-shaped ends 3. The Z-shaped ends 3 are obtained by bending, or crimping, the original ends of length 1 at an angle $\alpha$ to a crimping depth of h. The fiber 1 consists preferably of drawn steel wire, and the diameter of the fiber 1 can vary from 0.2 mm to 1.5 mm, depending on the use to which the steel wire fiber is being put. The length of the middle portion 2 is preferably equal to between 20 and 100 times the diameter of the fiber.

According to the invention, the middle portion 2 of the fiber 1 shows a substantially circular cross-section over essentially its entire length and the hook-shaped ends 3 of the fiber 1 are deformed by flattening. With the embodiment shown in FIG. 1, the Z-shaped ends 3 are flattened in the plane of the drawing or in a plane which is parallel with the plane of the wire element.

At least a portion 4 of the hook-shaped ends 3 of fiber 1 immediately adjacent middle portion 2 may be deformed by flattening, as shown in this embodiment and the other embodiments described in detail below. A tip or outer free end 5 of Z-shaped ends 3 may be deformed by flattening as shown in this embodiment and the others described below.

The cross-section of the flattened ends 3 can be substantially rectangular or ovular in shape. Hence the ends 3 of a wire element 1 having a substantially circular cross-section with a diameter of 1.05 mm can be flattened to a rectangular cross-section with a breadth of roughly 0.65 mm and a height of 1.33 mm. By degree of flattening is meant here the ratio of the original diameter to the breadth of the rectangular cross-section or the small axis of the oval-shaped cross-section. In the aforementioned example, the degree of flattening is 1.05: 0.65=1.62. It has been determined that the degree of flattening is preferably greater than 1.10 and less than 3.50. With too low a degree of flattening, the enhancement of the bending strength of the steel fiber reinforced concrete is less great; this is also the case with too high a degree of flattening and, moreover, great deforming forces are needed to obtain the desired degree of flattening. In the embodiment of the wire element 1 shown in FIG. 1, the degree of flattening of the flattened ends 3 is essentially constant over their entire length.

Figure 2:
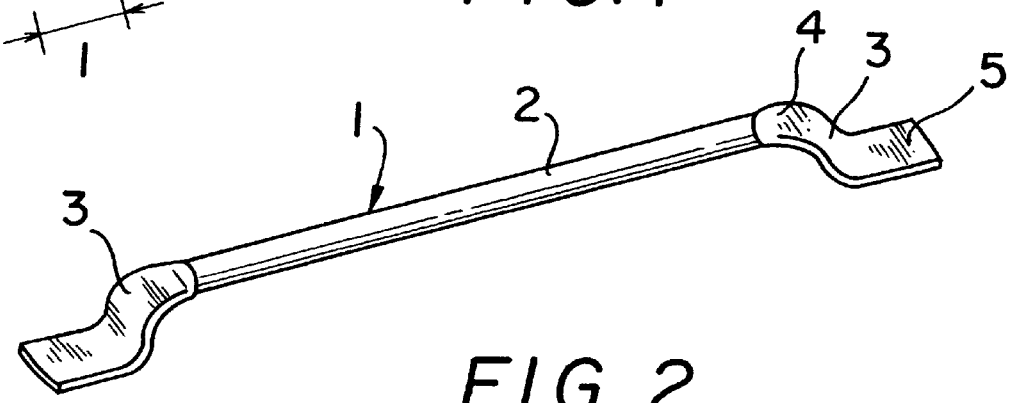
FIG. 2 shows in perspective a second embodiment of a steel wire element according to the invention, in which the Z-shaped ends are flattened in a plane perpendicular to the plane of the wire element.

FIG. 2 shows a second embodiment of a steel wire element 1 according to the invention. The difference between the embodiment shown in FIG. 1 and the embodiment shown in FIG. 2 consists in the fact that in the second instance the Z-shaped ends 3 are flattened in a plane perpendicular to the plane of the wire element 1.

Figure 3A:
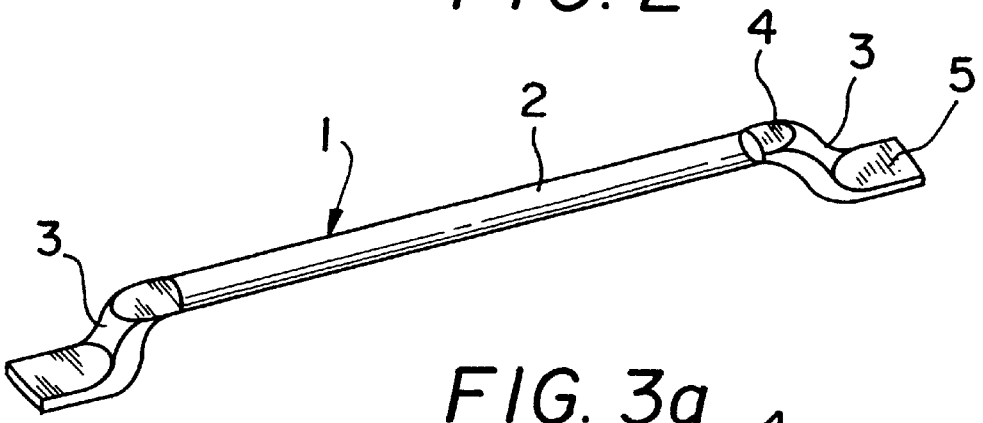
FIGS. 3*a* and 3*b* show in perspective two variants of a third embodiment of a steel wire element according to the invention, in which the Z-shaped ends are flattened in a plane perpendicular to the plane of the wire element, but with a degree of flattening that varies over the length of the flattened ends.

FIG. 3*a* shows a first variant of a third embodiment of a steel wire element 1 according to the invention, in which the Z-shaped ends 3, just as in FIG. 2. are flattened in a plane perpendicular to the plane of the wire element 1. but in which the degree of flattening of the flattened ends 3 varies over their length.

Figure 3B:
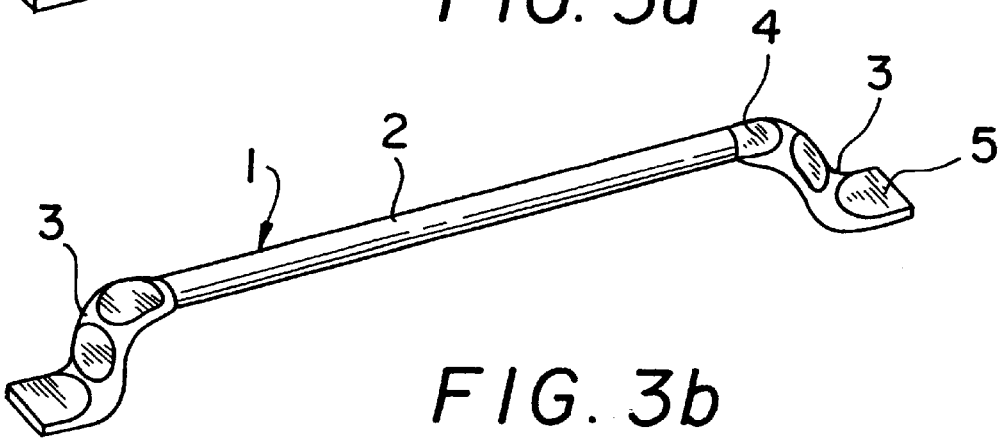

FIG. 3*b* shows a second variant of the third embodiment, in which the degree of flattening of the flattened ends 3 varies over their length. The degree of flattening is smaller at the bending points or bends of the Z-shaped ends 3 than in the immediately adjacent portions of the bends.

FIGS. 4 through 7 show longitudinal cross-sections of four different embodiments of steel wire elements 1 with L-shaped ends 3.

Figure 4:
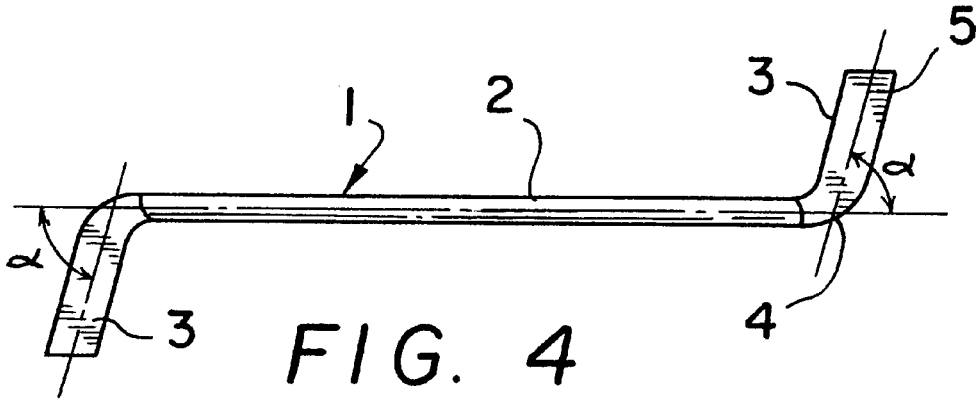
FIGS. 4 through 7 are longitudinal cross-sections of four different embodiments of steel wire elements with L-shaped ends.

FIG. 4 shows a fourth embodiment of a steel wire element 1 according to the invention. The difference between the embodiment shown in FIG. 1 and the embodiment shown in FIG. 4 consists in the fact that the Z-shaped ends 3 are now replaced by L-shaped ends 3, in which the L-shaped ends 3 are bent in opposite directions.

Figure 5:
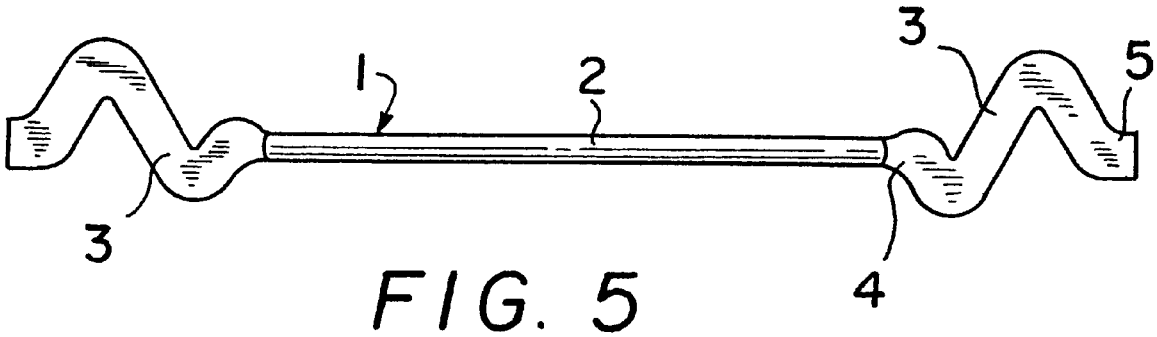
Figure 6:
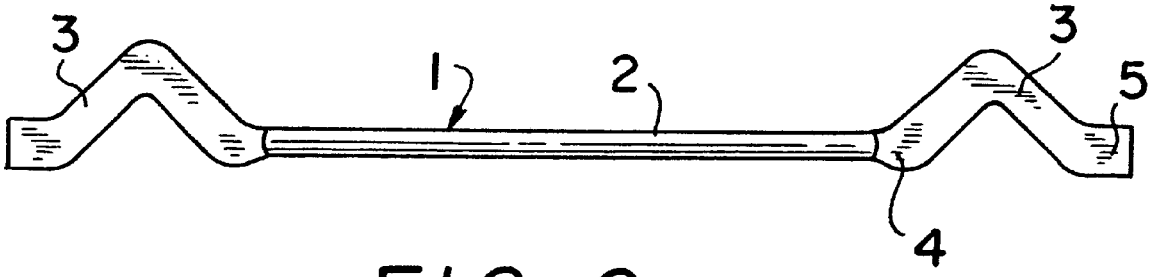
Figure 7:
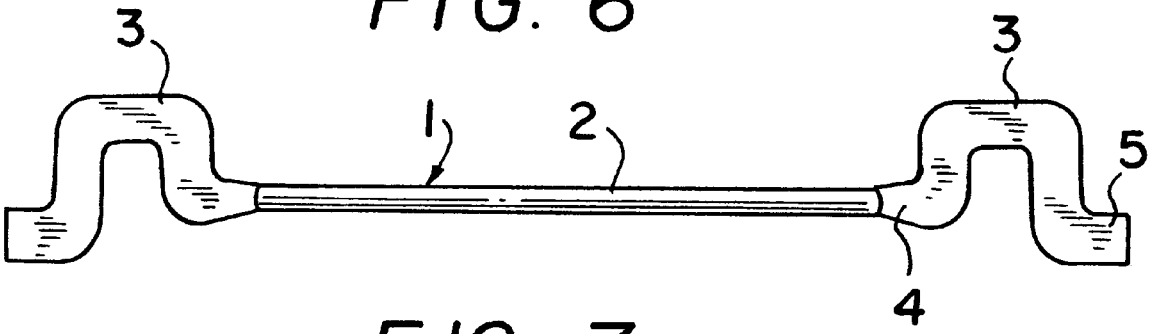

FIGS. 5, 6 and 7 show further embodiments of steel wire elements 1 with flattened L-shaped ends 3, in which, however, the flattened L-shaped ends 3 are provided with additional end structures to further increase the bonding in the concrete. It is clear that numerous other variants are also possible within the scope of the invention.

The invention will now be further explained on the basis of the tests that have been carried out on four different types of steel wire fibers 1 with Z-shaped ends. The four types are: basic type B or steel wire fiber with Z-shaped ends (non-flattened) according to the prior state of the art; type T1: steel wire fiber according to FIG. 1; type T2: steel wire fiber according to FIG. 2; type T3: steel wire fiber according to FIG. 3*b*.

The most important mechanical properties of the four types of fibers are shown in Table 1:

TABLE 1

| | diameter (mm) | length L (mm) | tensile strength (Newton/mm$^2$) | α degrees | l (mm) | h (mm) |
|---|---|---|---|---|---|---|
| B | 1.05 | 49 | 1180 | 40–50 | 2.1 | 2.0 |
| T1 | 1.05 | 51 | 1100 | 40–50 | 2.1 | 2.3 |
| T2 | 1.05 | 51 | 1100 | 40–50 | 2.5 | 2.0 |
| T3 | 1.05 | 51 | 1100 | 50–60 | 2.4 | 2.1 |

the values reported here are the average values of 10 measurements.

length L is the total length of the fiber (in mm).

diameter d: the nominal wire diameter in mm.

tensile strength of the straight middle portion in N/mm$^2$.

α: the angle at which the wire element 1 is bent.

l: the length in mm of the bent ends.

h: the crimping depth in mm.

the degree of flattening of types T1 and T2 is approximately 1.62 and is constant over the entire length; the degree of flattening of type T3 is also 1.62 on average, though it varies over the length.

Concrete test beams (length L=500 mm, height H=150 mm, breadth B=150 mm) were formed with fiber amounts of 20, 30, 40 and 50 kg/m$^3$ for each type of fiber and then subjected to a four-point stress test as described in CUR 35 or the NBN B15-238 and NBN B15-239 standards.

The testing conditions for the test beams are: test basis L=450 mm and l=150 mm. The equivalent bending tensile strength fe 300 (with deflection j=1.5 mm) (in N/mm$^2$) is given below in Table 2, in which n indicates the number of test beams per type and amount. The increase of the equivalent bending tensile strength fe 300 (j=1.5 mm) for types T1, T2 and T3 in relation to the basic type B is given in each case as a % (in parentheses).

TABLE 2

| Fibers (kg/mm$^3$) | B | T1 | T2 | T3 |
|---|---|---|---|---|
| 20 | 2.2 (n = 6) | 2.3 (+5%) (n = 6) | 2.6 (+18) (n = 6) | 2.6 (+18) (n = 6) |
| 30 | 2.9 (n = 5) | 2.9 (0) (n = 6) | 3.3 (+14) (n = 6) | 3.6 (24) (n = 5) |
| 40 | 3.2 (n = 6) | 3.6 (13) (n = 6) | 3.9 (22) (n = 6) | 4.2 (31) (n – 6) |
| 50 | 3.8 (n = 6) | 4.0 (5) (n = 6) | 4.4 (16) (n = 6) | 5.0 (32) (n = 6) |

The test results in Table 2 clearly indicate that the equivalent bending tensile strength fe 300 (j=1.5 mm) increases considerably with steel wire elements (types T1, T2 and T3) according to the invention. This means that to obtain a particular equivalent bending tensile strength in a steel fiber reinforced concrete construction—as, for example, a concrete floor—it will suffice to add a smaller amount of steel fibers according to the invention to the concrete.

It can further be concluded from the test results that the type T2 steel wire fibers produce better results than the type T1 fibers, and that the type T3 fibers produce still better results than the type T2 fibers.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as may be applied to the central features hereinbefore set forth, and fall within the scope of the invention and of the limits of the appended claims.

What is claimed is:

1. A wire element for mixing into subsequently hardening soft materials:

a) said element having hook-shaped ends and a middle portion;

b) said middle portion having a substantially circular cross section over substantially its entire length;

c) said middle portion having at least one hook-shaped end;

d) said at least one hook-shaped end being directly connected with said middle portion;

e) said at least one hook-shaped end having a tip;

f) said at least one hook-shaped end being substantially Z-shaped;

g) at least a portion of said at least one hook-shaped end immediately adjacent said middle portion being deformed by flattening; and h) at least a portion of said tip of said hook-shaped end being substantially entirely deformed by flattening.

2. A wire element as in claim 1, wherein:

a) said at least a portion of said at least one hook-shaped end deformed by flattening is disposed in a plane which is substantially parallel with a plane which contains said middle-portion.

3. A wire element as in claim 2, wherein:

a) said at least one hook-shaped end is deformed by variable flattening over substantially its entire length.

4. A wire element as in claim 1, wherein:

a) said at least a portion of said at least one hook-shaped end deformed by flattening is disposed in a plane which is substantially perpendicular with a plane which contains said middle portion.

5. A wire element as in claim 4, wherein:

a) said at least one hook-shaped end is deformed by variable flattening over substantially its entire length.

6. A wire element as in claim 1, wherein:

a) said at least a portion of said at least one hook-shaped end deformed by flattening is disposed in a plane which is at an angle with respect to a plane which contains said middle portion.

7. A wire element as in claim 1, wherein:

a) said at least one hook-shaped end is deformed by substantially constant flattening over substantially its entire length.

8. A wire element as in claim 7, wherein:

a) said element includes steel.

9. A wire element as in claim 1, wherein:

a) said at least one hook-shaped end is deformed by variable flattening over substantially its entire length.

10. A wire element as in claim 9, wherein:

a) said element includes steel.

11. A wire element as in claim 1, wherein:

a) said element includes steel.

12. A wire element as in claim 1, wherein:

a) said at least one hook-shaped end is deformed by variable flattening over substantially its entire length.

13. A wire element for mixing into subsequently hardening soft materials:

a) said element having hook-shaped ends and a middle portion;

b) said middle portion having a substantially circular cross section over substantially its entire length;

c) said middle portion having at least one hook-shaped end;

d) said at least one hook-shaped end being directly connected with said middle portion;

e) said at least one hook-shaped end having a tip;

f) said at least one hook-shaped end being substantially L-shaped;

g) at least a portion of said at least one hook-shaped end immediately adjacent said middle portion being deformed by flattening; and h) at least a portion of said tip of said hook-shaped end being substantially entirely deformed by flattening.

14. A wire element as in claim 13, wherein:

a) said at least a portion of said at least one hook-shaped end deformed by flattening is disposed in a plane which is substantially parallel with a plane which contains said middle portion.

15. A wire element as in claim 14, wherein:

a) said at least one hook-shaped end is deformed by variable flattening over substantially its entire length.

16. A wire element as in claim 13, wherein:

a) said at least a portion of said at least one hook-shaped end deformed by flattening is disposed in a plane which is substantially perpendicular with a plane which contains said middle portion.

17. A wire element as in claim 16, wherein:

a) said at least one hook-shaped end is deformed by variable flattening over substantially its entire length.

18. A wire element as in claim 13, wherein:

a) said at least a portion of said at least one hook-shaped end deformed by flattening is disposed in a plane which is at an angle with respect to a plane which contains said middle portion.

19. A wire element as in claim 13, wherein:

a) said at least one hook-shaped end is deformed by substantially constant flattening over substantially its entire length.

20. A wire element as in claim 19, wherein:

a) said element includes steel.

21. A wire element as in claim 13, wherein:

a) said at least one hook-shaped end is deformed by variable flattening over substantially its entire length.

22. A wire element as in claim 21, wherein:

a) said element includes steel.

23. A wire element as in claim 13, wherein:

a) said element includes steel.

24. A wire element as in claim 13, wherein:

a) said at least one hook-shaped end is deformed by variable flattening over substantially its entire length.

25. A wire element for mixing into subsequently hardening soft materials:

a) said element having hook-shaped ends and a middle portion;

b) said element middle portion having a length/diameter ratio between about 20 and about 100;

c) said middle portion having a substantially circular cross section over substantially its entire length;

d) said middle portion having hook-shaped ends;

e) said hook-shaped ends each being integral with said middle portion and each having a tip;

f) at least a portion of said hook-shaped ends immediately adjacent said middle portion being deformed by flattening;

g) at least a portion of said hook-shaped ends at said tip being deformed by flattening;

h) said middle portion having a diameter from about 1.5 mm to about 2 mm; and i) said tips and said hook-shaped ends adjacent said middle portion being flattened, with the degree of flattening relative to the diameter of said middle portion being greater than about 1.1 and less than about 3.5.

26. A wire element as in claim 25, wherein:

a) said middle portion is flattened to a breadth of about 0.65 mm and a height of about 1.33 mm.

27. A wire element as in claim 25, wherein:

a) said element includes steel.

28. A wire element as in claim 25, wherein:

a) said hook-shaped end is substantially Z-shaped.

29. A wire element as in claim 25, wherein:

a) said hook-shaped end is substantially L-shaped.

* * * * *

UNITED STATES PATENT AND TRADEMARK OFFICE

CERTIFICATE OF CORRECTION

PATENT NO. : 6,045,910
DATED : April 4, 2000
INVENTOR(S) : Lambrechts

It is certified that error appears in the above-identified patent and that said Letters Patent is hereby corrected as shown below:

Column 7,
Lines 13 & 14, please change "1.5 mm to about 2 mm;" to -- 0.2 mm to about 1.5 mm; --.

Signed and Sealed this

Sixteenth Day of April, 2002

*Attest:*

*Attesting Officer*

JAMES E. ROGAN
*Director of the United States Patent and Trademark Office*